US007553185B1

(12) United States Patent
Qu et al.

(10) Patent No.: US 7,553,185 B1
(45) Date of Patent: Jun. 30, 2009

(54) DUAL-EXTRUSION AIRTIGHT RF COAXIAL CONNECTOR WITH SELF-LOCKING BY SNAP-FASTENING

(76) Inventors: Jinliang Qu, Room 302, Gudai Road 1266-48, Shanghai 201102 (CN); Weiquan Zhou, 2nd Floor, No. 160 DingMaoQiao Road, Zhenjiang City, Jiangsu 212009 (CN)

( * ) Notice: Subject to any disclaimer, the term of this patent is extended or adjusted under 35 U.S.C. 154(b) by 0 days.

(21) Appl. No.: 12/149,708

(22) Filed: May 7, 2008

(51) Int. Cl.
*H01R 9/05* (2006.01)

(52) U.S. Cl. ..... 439/578

(58) Field of Classification Search ..... 439/271, 439/272, 345, 357, 578, 675
See application file for complete search history.

(56) References Cited

U.S. PATENT DOCUMENTS 6,692,286 B1 2/2004 De Cet
7,351,088 B1 * 4/2008 Qu ..... 439/352

FOREIGN PATENT DOCUMENTS

WO WO 01/31752 5/2001

* cited by examiner

*Primary Examiner*—Khiem Nguyen
(74) *Attorney, Agent, or Firm*—McDermott Will & Emery LLP

(57) ABSTRACT

An airtight RF coaxial connector with self-locking by snap-fastening comprises a plug connector and a socket connector, which is characterized in that the elastic locking element of the plug connector used for locking the socket outer conductor of the socket connector is fixed on the outer surface of the plug outer conductor of the plug connector along its radius; that the front end of the inner hole of the plug outer conductor of the plug connector is provided with a sealing groove; and that the sealing groove is provided with a sealing ring whose free inner diameter is shorter than the external diameter of the outer conductor of the socket connector. The chamfer at the front end of the socket connector makes pre-extrusion to the O-shaped sealing ring in the sealing groove. When the plug connector is further inserted into the socket, the conical surface on the locking bulge on the outer conductor of the socket connector re-extrudes the O-shaped sealing ring, and realizes a good sealing effect. In particular, the dual-extrusion has little damage to the sealing ring, and thus greatly increases the lifetime of the sealing ring.

5 Claims, 3 Drawing Sheets

DUAL-EXTRUSION AIRTIGHT RF COAXIAL CONNECTOR WITH SELF-LOCKING BY SNAP-FASTENING

FIELD OF THE INVENTION

The present invention relates to an airtight RF coaxial connector with self-locking by snap-fastening, in particular, to a dual-extrusion airtight RF coaxial connector with self-locking by snap-fastening.

PRIOR ART

ZL00814657.8 discloses an RF coaxial connector that replaces SMA threaded connection in a simple and swift way. However, the RF coaxial connector fails to apply the sealing ring of SMA threaded connection that can be used for preventing dust, mould, and mist. Thus, dust, mould, and mist can enter the contact elements in the conductor through the clearance of the metal elastic elements with notch, and oxygenize the metal contact elements. The substances like mist and sulfur dioxide will corrode the surfaces of the metals, and thus increase the contact resistance or even make the electrical connector deficient.

SUMMARY OF THE INVENTION

The object of the present invention is to provide an airtight RF coaxial connector with self-locking by snap-fastening, which can prevent harmful substances, such as dust, mould, oxygen, sulfur dioxide, and water, from entering the connector and oxidizing or corroding the contacting portions in order to greatly improve the reliability of the connector.

Another object of the present invention is to provide an airtight RF coaxial connector with self-locking by snap-fastening, which can realize ideal sealing effect through the dual-extrusion of the sealing ring during the process of connection so as to decrease the damage to the sealing ring and to greatly increase its lifetime. Another object of the present invention is to provide an airtight RF coaxial connector with self-locking by snap-fastening. The elastic locking means between the plug connector and the socket connector is provided on the outer surface of the outer conductor of the plug connector, softening the locking elasticity between the plug connector and the socket connector in connection.

Therefore, the present invention provides an airtight RF coaxial connector with self-locking by snap-fastening, comprising a plug connector and a socket connector, characterized in that the elastic locking element of the plug connector used for locking the socket outer conductor of the socket connector is fixed on the outer surface of the plug outer conductor of the plug connector along its radius; that the front end of the inner hole of the plug outer conductor of the plug connector is provided with a sealing groove; and that the sealing groove is provided with a sealing ring whose free inner diameter is shorter than the external diameter of the outer conductor of the socket connector.

Preferably, the cross section of the sealing groove is in the shape of a trapezoid, and the hypotenuse side of the trapezoid is positioned facing the inner hole of the plug outer conductor of the plug connector.

Preferably, the cross section of the sealing ring is in the shape of a circle or trapezoid.

Preferably, the mid-point of the sealing ring is located at the joint portion between the conical surface of the locking bulge on the outer conductor of the socket connector and the cylindrical surface of the outer conductor of the socket connector.

Preferably, the distance between the mid-point of the sealing ring and the front contacting surface of the plug outer conductor is the same as that between the front contacting surface of the socket connector and the joint portion of the conical surface of the locking bulge on the outer conductor of the socket connector and the cylindrical surface of the outer conductor of the socket connector in connection.

Another embodiment of the present invention provides an airtight RF coaxial connector with self-locking by snap-fastening, comprising a plug connector and a socket connector, characterized in that the elastic locking element of the plug connector used for locking the socket outer conductor of the socket connector is fixed on the outer surface of the plug outer conductor of the plug connector along its radius; that the conical surface of the locking bulge on the outer conductor of the socket connector is provided with a sealing groove; and that the sealing groove is provided with a sealing ring whose free external diameter is longer than the inner diameter of the plug outer conductor of the plug connector.

The present invention provides an airtight RF coaxial connector with self-locking by snap-fastening, whose plug connector is provided with an elastic locking element used to lock the socket outer conductor of the socket connector. The elastic locking element is an elastic locking means, which is moved from the inner part of the outer conductor of the plug connector and fixed on the cylindrical surface of the outer conductor of the plug connector. The elastic locking element is also cut to form for example ten elastic slits longitudinally, softening the elasticity of the element without affecting its locking effects.

In particular, the outer conductor of the plug connector maintains an intact structure without longitudinal slits, and strengthens the stiffness of the front end of the outer conductor of the plug connector and the connecting retentiveness of the connector.

In particular, the chamfer at the front end of the socket connector will make pre-extrusion to the O-shaped sealing ring in the sealing groove. When the plug connector is further connected with the socket, the second conical surface on the locking bulge on the outer conductor of the socket connector will re-extrude the O-shaped sealing ring, and realize better sealing effect. In particular, the dual-extrusion has little damage to the sealing ring, and thus greatly increases the lifetime of the sealing ring.

In particular, when the plug connector is connected with the socket connector, the outer conductor directly contacts with the outer conductor of the socket connector, lowering the contact resistance while increasing the contact reliability.

DETAILED DESCRIPTION OF THE PRESENT INVENTION

Figure 1:
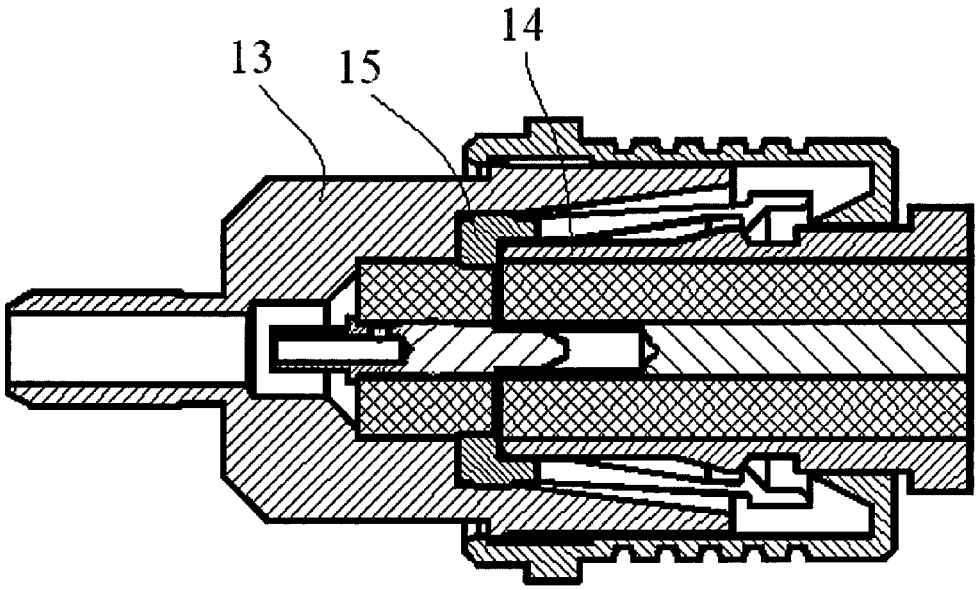
FIG. 1 shows a schematic view of the structure of the electrical connector whose plug is connected with the socket according to the prior art.
Figure 2:
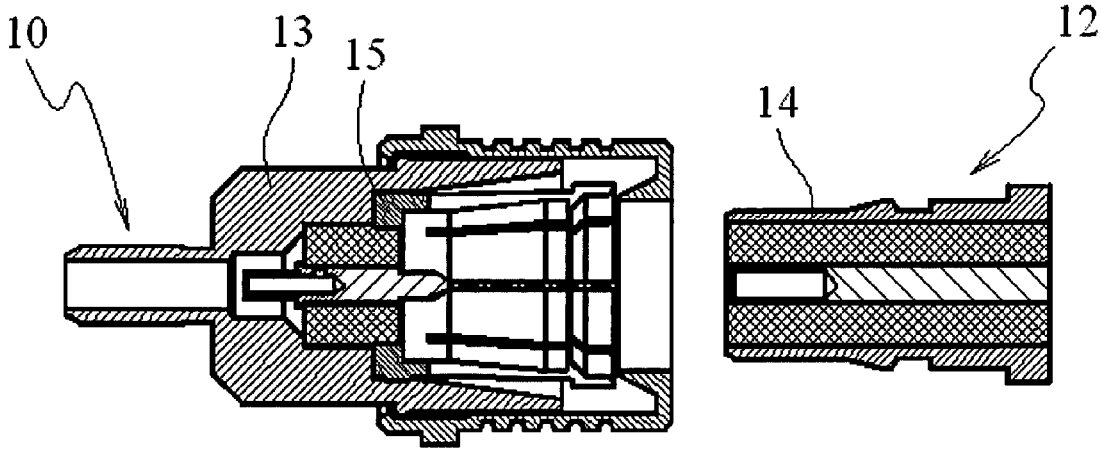
FIG. 2 shows a schematic view of the structure of the electrical connector whose plug is disconnected with the socket according to the prior art.

As shown in FIGS. 1 and 2, according to the prior art, the plug outer conductor 13 of the plug connector 10 is provided with an elastic locking element 15 in the shape of a cylinder and provided with longitudinal slits. The elastic locking element 15 is used to lock the socket outer conductor 14 of the socket connector 12 in order to connect the plug connector 10 with the socket connector 12.

It is noted that when the plug connector 10 is connected with the socket connector 12, the plug outer conductor 13 of the plug connector 10 is separated with the socket outer conductor 14 of the socket connector 12 by the generally cylinder shaped elastic locking element.

Therefore, according to the prior art solution, no sealing ring for the prevention of dust, mould, and mist can be provided on the plug connector 10 or the socket connector 12. Therefore, dust, mould, and mist can enter the contacting part between the plug outer conductor 13 and the socket connector 12 through the clearance of the cylinder-shaped elastic locking element 15. Substances like mist and sulfur dioxide in the air can corrode the metal surfaces of the plug outer conductor 13 and the socket connector 12, and increase the contact resistance of the two connectors, or even make the electric connectors deficient.

Figure 3:
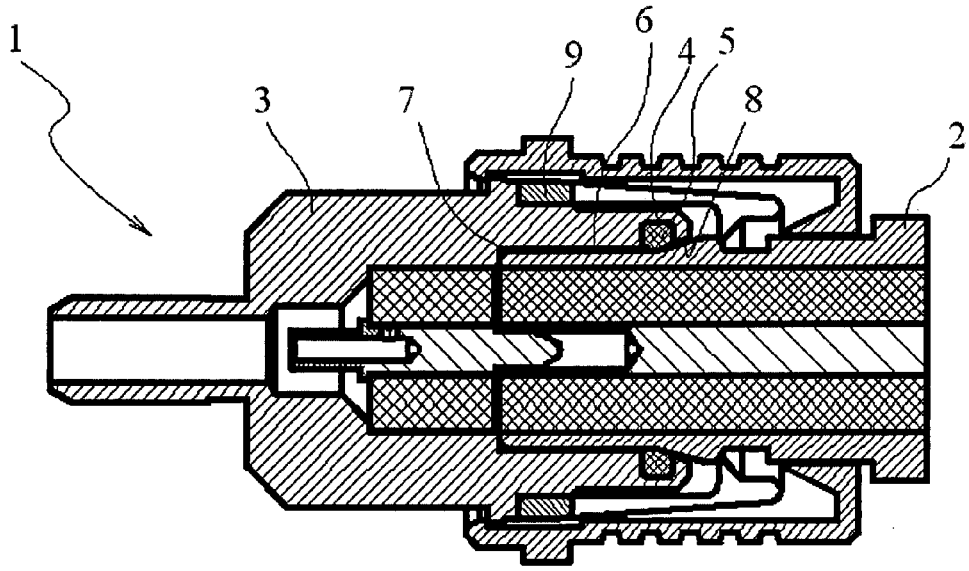
FIG. 3 shows a schematic view of the structure of the electrical connector whose plug is connected with the socket according to the present invention.
Figure 4:
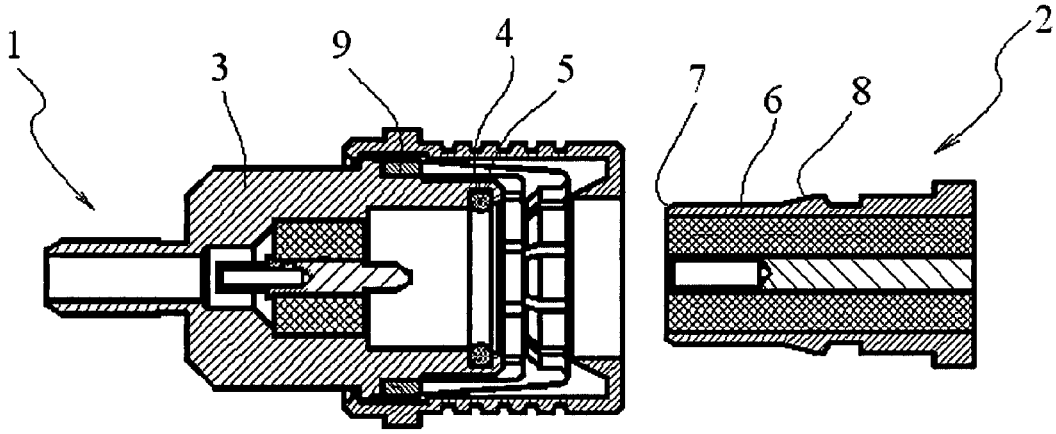
FIG. 4 shows a schematic view of the structure of the electrical connector whose plug is disconnected with the socket according to the present invention.
Figure 5:
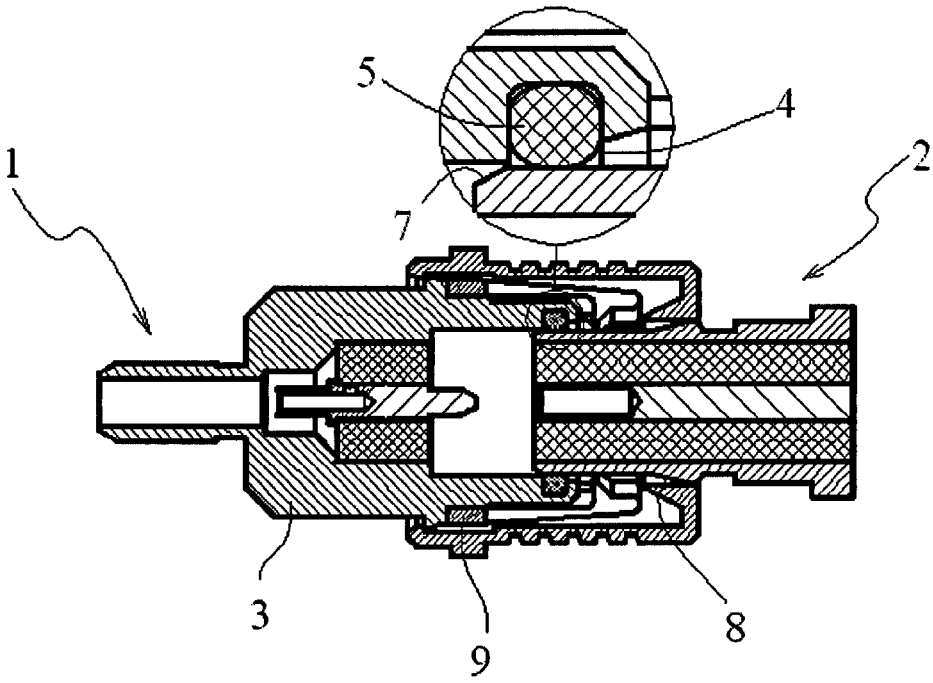
FIG. 5 shows a schematic view of the structure of the electrical connector whose plug and socket are under the pre-extrusion according to the present invention.
Figure 6:
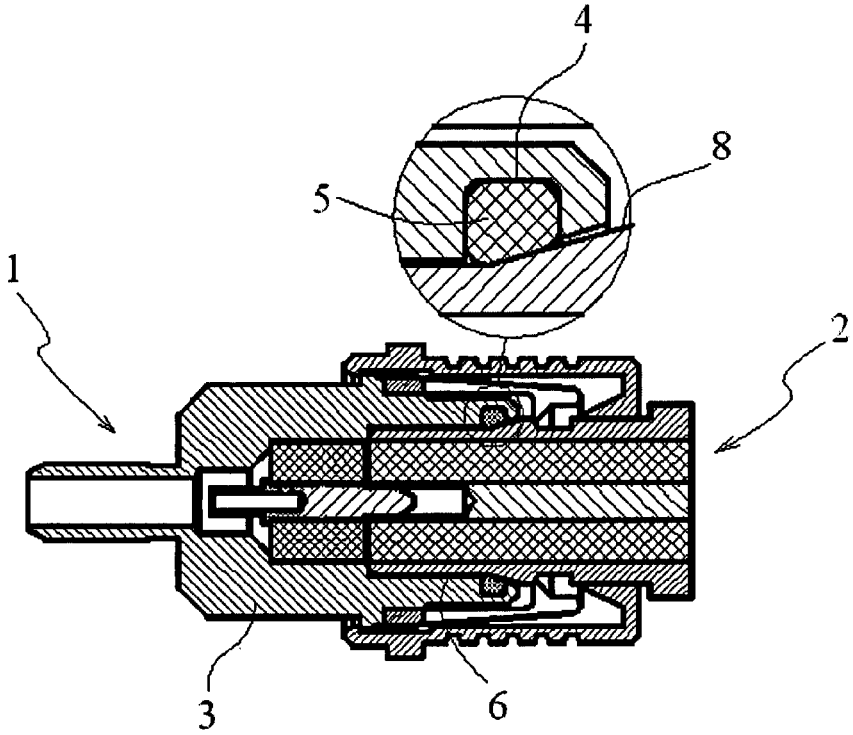
FIG. 6 shows a schematic view of the structure of the electrical connector whose plug and socket are under the further-extrusion according to the present invention.

As shown in FIGS. 3 and 4, in accordance with the present invention, the airtight RF coaxial connector with self-locking by snap-fastening comprises a plug connector 1 and a socket connector 2. The generally cylinder shaped elastic locking element 9 is positioned on the outer surface of the plug outer conductor of the plug connector 1 along its radius. The locking element 9 can be used to lock the socket outer conductor 6 of the socket connector 2 so as to connect the plug connector 1 with the socket connector 2.

The generally cylinder shaped elastic locking element 9 can be provided with several longitudinal slits in order to increase its elasticity.

It is noted that when the plug connector 1 is connected with the socket connector 2, the elastic locking element 9 on the outside surface of the plug outer conductor 3 of the plug connector 1 can be directly locked with the socket outer conductor 6 of the socket connector 2 without being separated by the generally cylinder shaped elastic locking element 9.

In an embodiment as shown in FIGS. 3-6, the front end of the inner hole of the plug outer conductor 3 of the plug connector 1 is provided with a sealing groove 4 provided with an O-shaped sealing ring 5.

When the plug connector 1 begins to be inserted into the socket connector 2, the conical surface 7 of the chamfer at the front end of the socket connector 2 makes pre-extrusion to the O-shaped sealing ring 5 in the sealing groove 4.

When the plug connector 1 is further inserted into the socket connector 2, the conical surface 8 on the locking bulge on the outer conductor 6 of the socket connector 2 re-extrudes the O-shaped sealing ring 5 more forcefully.

Through the above dual-extrusion, the plug outer conductor 3 of the plug connector 1 has great sealing effects with the socket outer conductor 6 of the socket connector 2, preventing dust, mould, carbon dioxide, oxygen, mist, or other corrosive substances from entering the inner contacting portion between the plug outer conductor 3 and the socket outer conductor 6. By doing so, the key connecting portions of the plug outer conductor 3 of the plug connector 1 and the socket outer conductor 6 of the socket connector 2 are prevented from being oxygenized or damaged by the harmful substances. So, the reliability of the connectors is greatly increased and their lifetime is expanded. In particular, connectors with such kind of sealing device can be used outdoors or in relatively poor working environment.

The chamfer at the bottom end of the socket connector 2 is usually 45°, but it can also be of other angle like 30°, or the angle convenient for pre-extrusion to the sealing ring when the connector is to be connected.

As a matter of fact, there can be other embodiments according to the concept of the present invention.

For instance, the sealing ring can also be provided on the conical surface 8 on the locking bulge on the outer conductor 6 of the socket connector 2, while no sealing groove 4 is provided at the front end of the inner hole of the plug outer conductor 3 of the plug connector 1.

Those skilled in the art can easily modify, alter or improve the present invention according to the concept of this patent application. However, it is still in the scope of protection as claimed in the attached claims.

The invention claimed is:

1. An airtight RF coaxial connector with self-locking by snap-fastening, comprising a plug connector (1) and a socket connector (2), characterized in that an elastic locking element (9) of the plug connector (1) used for locking the socket outer conductor (6) of the socket connector (2) is fixed on the outer surface of the plug outer conductor (3) of the plug connector (1) along its radius; and the front end of an inner hole of the plug outer conductor (3) of the plug connector (1) is provided with a sealing groove (4), and the sealing groove (4) is provided with a sealing ring (5) whose free inner diameter is shorter than the external diameter of the outer conductor (6) of the socket connector (2).

2. The Airtight RF coaxial connector with self-locking by snap-fastening according to claim 1, characterized in that the cross section of the sealing groove is in the shape of a trapezoid, and the hypotenuse side of the trapezoid is positioned facing the inner hole of the plug outer conductor (3) of the plug connector (1).

3. The airtight RF coaxial connector with self-locking by snap-fastening according to claim 1, characterized in that the cross section of the sealing ring is in the shape of a circle or trapezoid.

4. The airtight RF coaxial connector with self-locking by snap-fastening according to claim 1, characterized in that the mid-point of the sealing ring (5) corresponds to the joint portion between a conical surface (8) of the locking bulge on the outer conductor (6) of the socket connector (2) and the cylindrical surface of the outer conductor (6) of the socket connector (2) in connection.

5. The airtight RF coaxial connector with self-locking by snap-fastening according to claim 1, characterized in that the distance between the mid-point of the sealing ring (5) and the front surface of the plug outer conductor is the same as that between the front surface of the socket connector and the joint portion of the conical surface (8) of the locking bulge on the outer conductor (6) of the socket connector (2) and the cylindrical surface of the outer conductor (6) of the socket connector (2).

* * * * *

US007553185C1

(12) EX PARTE REEXAMINATION CERTIFICATE (8541st)

United States Patent

Qu et al.

(10) Number: US 7,553,185 C1

(45) Certificate Issued: Sep. 13, 2011

(54) DUAL-EXTRUSION AIRTIGHT RF COAXIAL CONNECTOR WITH SELF-LOCKING BY SNAP-FASTENING

(76) Inventors: Jinliang Qu, Shanghai (CN); Weiquan Zhou, Zhenjiang (CN)

Reexamination Request:
No. 90/011,216, Sep. 9, 2010

Reexamination Certificate for:

| | |
|---|---|
| Patent No.: | **7,553,185** |
| Issued: | **Jun. 30, 2009** |
| Appl. No.: | **12/149,708** |
| Filed: | **May 7, 2008** |

(51) Int. Cl.
*H01R 9/05* (2006.01)

(52) U.S. Cl. ..... 439/578

(58) Field of Classification Search ..... None
See application file for complete search history.

(56) References Cited

U.S. PATENT DOCUMENTS 2,394,364 A 2/1946 Christensen
7,481,673 B1 1/2009 Qu et al.

FOREIGN PATENT DOCUMENTS

WO 2007085099 A1 8/2007

OTHER PUBLICATIONS

Haberhauer and Bodenstein, "Maschinenelements", 10th edition, p. 268 (1996).

*Primary Examiner*—Linh M. Nguyen

(57) ABSTRACT

An airtight RF coaxial connector with self-locking by snap-fastening comprises a plug connector and a socket connector, which is characterized in that the elastic locking element of the plug connector used for locking the socket outer conductor of the socket connector is fixed on the outer surface of the plug outer conductor of the plug connector along its radius; that the front end of the inner hole of the plug outer conductor of the plug connector is provided with a sealing groove; and that the sealing groove is provided with a sealing ring whose free inner diameter is shorter than the external diameter of the other conductor of the socket connector. The chamfer at the front end of the socket connector makes pre-extrusion to the O-shaped sealing ring in the sealing groove. When the plug connector is further inserted into the socket, the conical surface on the locking bulge on the outer conductor of the socket connector re-extrudes the O-shaped sealing ring, and realizes a good sealing effect. In particular, the dual-extrusion has little damage to the sealing ring, and thus greatly increases the lifetime of the sealing ring.

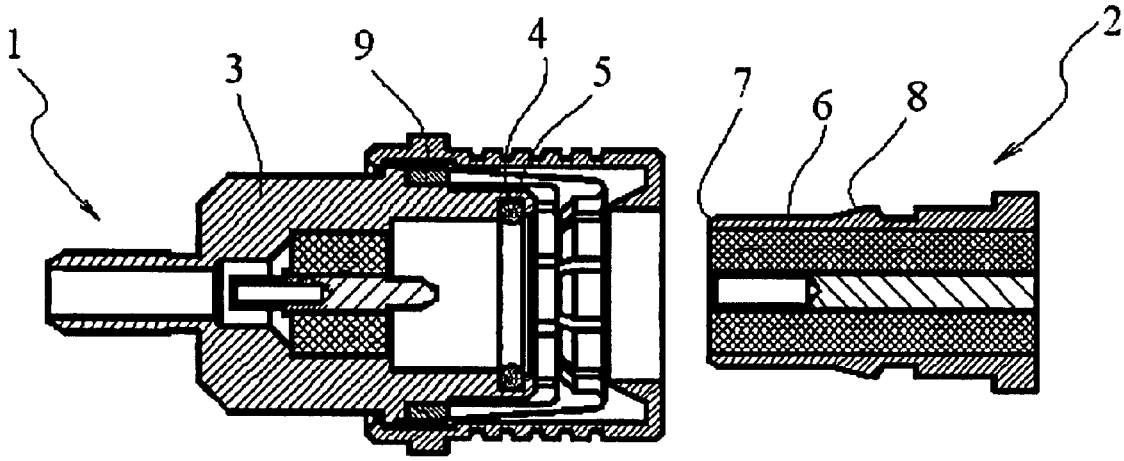

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 2 and 4 are cancelled.

Claim 1 is determined to be patentable as amended.

Claims 3 and 5, dependent on an amended claim, are determined to be patentable.

1. An airtight RF coaxial connector with self-locking by snap-fastening, comprising a plug connector (1) and a socket connector (2), [characterized in that]

an elastic locking element (9) of the plug connector (1) used for locking the socket outer conductor (6) of the socket connector (2) [is] *being* fixed on the outer surface of the plug outer conductor (3) of the plug connector (1) along its radius[; and], *the airtight RF coaxial connector being characterized in that:* the front end of an inner hole of the plug outer conductor (3) of the plug connector (1) is provided with a sealing groove (4), and the sealing groove (4) is provided with a sealing ring (5) whose free inner diameter is shorter than the external diameter of the outer conductor (6) of the socket connector (2)[.],

*the cross section of the sealing groove is in the shape of a trapezoid, and the hypotenuse side of the trapezoid is positioned facing the inner hole of the plug outer conductor (3) of the plug connector (1), and*

*the mid-point of the sealing ring (5) corresponds to the joint portion between a conical surface (8) of the locking bulge on the outer conductor (6) of the socket connector (2) and the cylindrical surface of the outer conductor (6) of the socket connector (2) in connection.*

* * * * *